US007222444B2

(12) United States Patent
Hendron et al.

(10) Patent No.: US 7,222,444 B2
(45) Date of Patent: May 29, 2007

(54) COORDINATED LINKAGE SYSTEM FOR A WORK VEHICLE

(75) Inventors: Scott Svend Hendron, Dubuque, IA (US); Judson Paul Clark, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/970,622

(22) Filed: Oct. 21, 2004

(65) Prior Publication Data

US 2006/0096137 A1 May 11, 2006

(51) Int. Cl.
*E02F 5/02* (2006.01)

(52) U.S. Cl. ..... 37/348; 37/414; 172/239

(58) Field of Classification Search ..... 172/2, 172/239; 37/348, 414–416
See application file for complete search history.

(56) References Cited

U.S. PATENT DOCUMENTS

| | | | | |
|---|---|---|---|---|
| 3,974,699 | A | 8/1976 | Morris et al. | 73/865.9 |
| 4,318,663 | A | 3/1982 | Waite | 414/707 |
| 4,628,734 | A | 12/1986 | Watson | 73/505 |
| 4,630,685 | A | 12/1986 | Huck et al. | 172/7 |
| 4,800,721 | A | 1/1989 | Cemenska et al. | 60/393 |
| 4,844,685 | A | 7/1989 | Sagaser | 414/700 |
| 4,888,890 | A * | 12/1989 | Studebaker et al. | 37/348 |
| 4,923,326 | A | 5/1990 | Fietzke | 403/371 |
| 4,934,463 | A * | 6/1990 | Ishida et al. | 172/4.5 |
| 5,002,454 | A | 3/1991 | Hadank et al. | 414/695.5 |
| 5,160,239 | A | 11/1992 | Allen et al. | 414/699 |
| 5,178,510 | A * | 1/1993 | Hanamoto et al. | 414/694 |
| 5,218,820 | A | 6/1993 | Sepehri et al. | 60/463 |
| 5,307,631 | A * | 5/1994 | Tatsumi et al. | 60/452 |
| 5,356,260 | A | 10/1994 | Ikari et al. | 414/700 |
| 5,424,623 | A | 6/1995 | Allen et al. | 318/568.18 |
| 5,551,518 | A * | 9/1996 | Stratton | 172/4.5 |
| 5,576,976 | A | 11/1996 | White | 702/190 |
| 5,784,944 | A * | 7/1998 | Tozawa et al. | 91/361 |
| 5,850,035 | A | 12/1998 | Layton et al. | 73/504.16 |
| 5,887,365 | A * | 3/1999 | Fujishima et al. | 37/348 |
| 6,003,373 | A | 12/1999 | Moore et al. | 73/504.16 |
| 6,108,948 | A * | 8/2000 | Tozawa et al. | 37/348 |
| 6,233,511 | B1 | 5/2001 | Berger et al. | 701/50 |
| 6,356,829 | B1 | 3/2002 | Fan et al. | 701/50 |
| 6,363,632 | B1 * | 4/2002 | Stentz et al. | 37/414 |

(Continued)

FOREIGN PATENT DOCUMENTS

| | | |
|---|---|---|
| JP | 1-178622 | 7/1989 |

(Continued)

*Primary Examiner*—Thomas A Beach

(57) ABSTRACT

A work vehicle with a tool pivotally attached to a linkage, an actuator for controllably moving the tool about its pivot, and a tilt angle sensor for sensing the absolute angle of the work tool relative to the earth. A controller is adapted to perform an auto-hold function for the tool, automatically maintaining an initial tool orientation by commanding movement of the tool actuator to hold the work tool at about the initial or set absolute angle of the tool. The controller is adapted to discontinue the tool auto-hold function when the operator manipulates a tool command input device affecting tool actuator movement, and resume the tool auto-hold function at the new orientation affected by the operator. Manipulation of an auto-hold command input device allows the operator to selectively enable and disable the tool auto-hold function.

22 Claims, 2 Drawing Sheets

U.S. PATENT DOCUMENTS

| | | | | |
|---|---|---|---|---|
| 6,374,153 | B1 | 4/2002 | Brandt et al. | 700/188 |
| 6,434,437 | B1 | 8/2002 | Brandt et al. | 700/69 |
| 6,609,315 | B1 | 8/2003 | Hendron et al. | 37/348 |
| 6,618,659 | B1 * | 9/2003 | Berger et al. | 701/50 |
| 2003/0147727 | A1 * | 8/2003 | Fujishima et al. | 414/200 |

FOREIGN PATENT DOCUMENTS

| | | |
|---|---|---|
| JP | 7-180192 | 7/1995 |
| JP | 10-245866 | 9/1998 |

* cited by examiner

FIG. 2
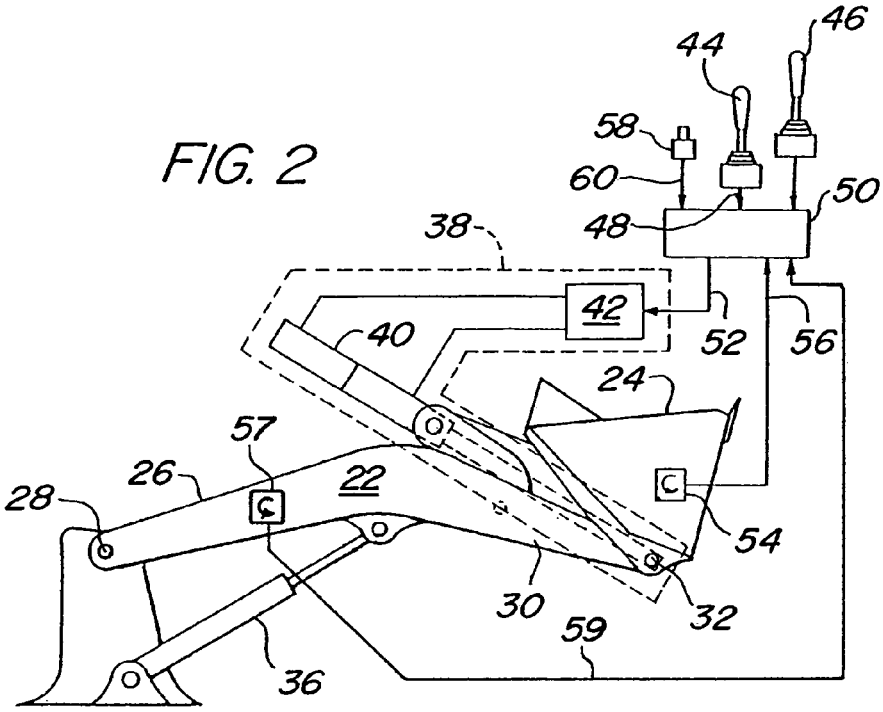
FIG. 3
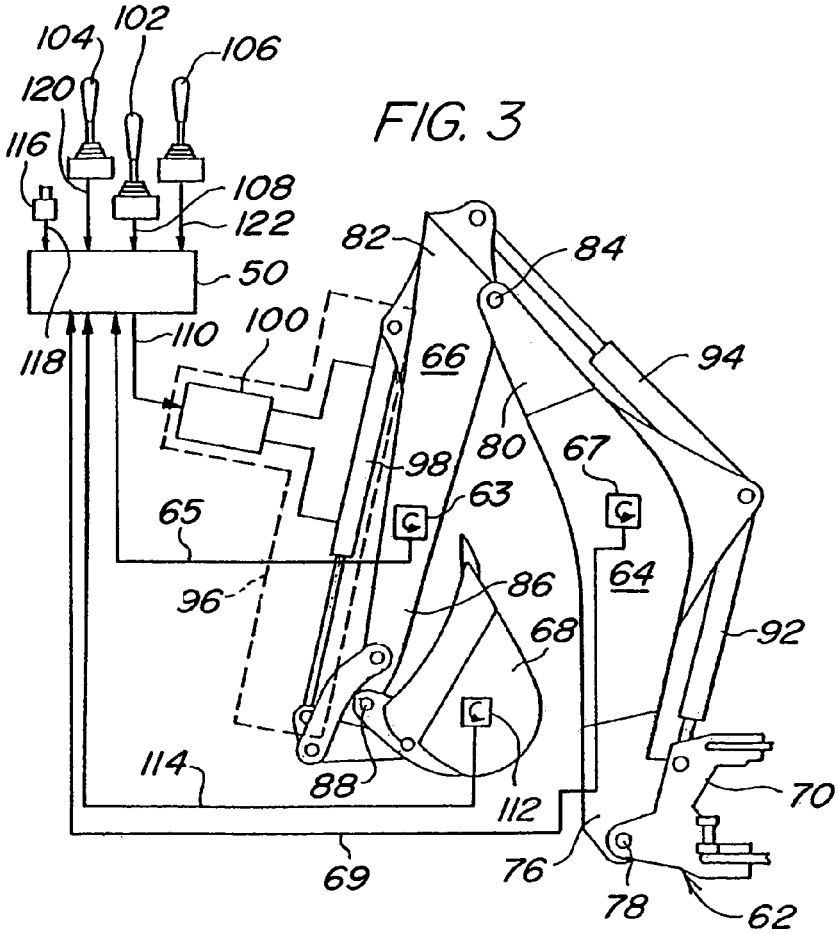
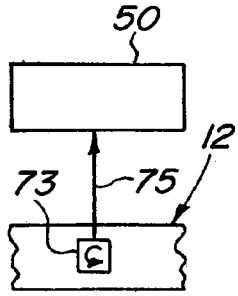
FIG. 4

COORDINATED LINKAGE SYSTEM FOR A WORK VEHICLE

FIELD OF THE INVENTION

The invention relates to a system for sensing and automatically controlling the orientation of a work tool with respect to the earth.

BACKGROUND OF THE INVENTION

A variety of work machines can be equipped with tools for performing a work function. Examples of such machines include a wide variety of loaders, excavators, tele-handlers, and aerial lifts. A work vehicle such as backhoe loader may be equipped with a first tool, such as a backhoe bucket or other structure, for excavating and material handling functions. A swing frame pivotally attaches to the vehicle frame at a rear portion of the vehicle, a backhoe boom pivotally attaches to the swing frame, a dipperstick pivotally attaches to the backhoe boom, and the work tool pivotally attaches to the dipperstick about a backhoe bucket pivot. A vehicle operator controls the orientation of the first tool relative to the dipperstick by a first tool actuator. The operator also controls the rotational position of the boom relative to the vehicle frame, and the dipperstick relative to the boom, by corresponding actuators. The aforementioned actuators are typically comprised of one or more double acting hydraulic cylinders and a corresponding hydraulic circuit.

During a work operation with a backhoe bucket, such as lifting or excavating material, it is desirable to maintain an initial orientation relative to gravity to prevent premature dumping of material, or to obtain a constant excavation shear angle. To maintain the initial backhoe bucket orientation relative to gravity, the operator is required to continually manipulate the backhoe bucket command input device to adjust the backhoe bucket orientation as the backhoe boom and dipperstick are moved during the work operation. The continual adjustment of the backhoe bucket orientation, combined with the simultaneous manipulation of a backhoe boom command input device and a dipperstick command input device inherent in movement of the backhoe boom and dipperstick, requires a degree of operator attention and manual effort that diminishes overall work efficiency and increases operator fatigue.

A loader boom is pivotally attached to the vehicle frame at a front portion of the backhoe loader and a second tool, such as a loader bucket, is pivotally attached to the loader boom at a loader bucket pivot. Work operation with a loader bucket entails similar problems to those encountered in work operations with the backhoe bucket.

A number of mechanisms and systems have been used to automatically control the orientation of work tools such as backhoe and loader buckets. Various examples of electronic sensing and control systems are disclosed in U.S. Pat. Nos. 4,923,326, 4,844,685, 5,356,260, 6,233,511, and 6,609,315. Control systems of the prior art typically utilize position sensors attached at various locations on the work vehicle to sense and control tool orientation relative to the vehicle frame. Additionally, the inventors' patent, U.S. Pat. No. 6,609,315, makes use of an angular velocity sensor attached to the tool to sense and maintain a fixed work tool orientation relative to an initial tool orientation, independent of vehicle frame orientation. The invention, described and claimed herein, makes use of a tilt sensor that, when attached to an object, such as the tool, detects the object's inclination with respect to the earth. The inclination of the tool is detected independently of the vehicle frame orientation and independently of the initial orientation of the tool. The result is a simpler control system and improved tool orientation control relative to gravity.

The particular type of tilt sensor utilized in the invention makes use of a new micro-electromechanical structures (MEMS) technology and is commercially available from Crossbow International, Inc. A number of other tilt sensors, including those utilizing capacitive technology, would be suitable for use in the invention and are also commercially available.

SUMMARY OF THE INVENTION

An object of the present invention is to provide an improved system for sensing and automatically controlling the orientation of a tool for a work vehicle.

The system automatically controls tool orientation by making use of a tilt sensor attached to the tool to detect an angle of the tool with respect to the earth. A controller maintains the tool at a selected angle.

The illustrated invention comprises a backhoe loader which includes a backhoe assembly, and a loader assembly. The backhoe assembly includes a swing frame pivotally attached to the frame of the backhoe loader, a backhoe boom pivotally attached to the swing frame, a backhoe boom actuator for controllably pivoting the boom relative to the swing frame, a dipperstick pivotally attached to the boom, a dipperstick actuator for controllably pivoting the dipperstick relative to the boom, a backhoe tool pivotally attached to the dipperstick, a backhoe tool actuator for controllably moving the backhoe tool about its pivot, and the aforementioned tilt sensor. The swing frame, the backhoe boom and the dipperstick shall be referenced herein as the backhoe linkage. A controller processes data from the tilt sensor and commands movement of the tool actuator in response thereto. The illustrated embodiment of the backhoe also includes a backhoe tool command input device to effect operation of the backhoe tool actuator, and a tool auto-hold command input device to enable a tool auto-hold function for maintaining the tool in a set orientation.

The loader includes a loader boom pivotally attached to the vehicle frame, a loader boom actuator for controllably pivoting the loader boom relative to the vehicle frame, a loader tool pivotally attached to the loader boom, and a loader tool actuator for controllably pivoting the loader tool relative to the loader boom. The loader also includes a loader tool command device to effect operation of the loader tool actuator and a loader tool auto-hold command input device to enable a loader tool auto-hold function for maintaining the loader tool in a set orientation.

When an tool auto-hold function is enabled, the controller maintains a tool orientation by commanding the tool actuator to move the tool such that the detected angle, i.e., the output voltage of the tilt sensor remains about the same. The controller is adapted to discontinue the tool auto-hold function when the operator manipulates the tool command input device to effect tool movement. The controller resumes tool auto-hold function once the operator discontinues manipulation of the tool command input device, reestablishing the initial tool orientation at the new orientation affected by the operator. Additionally, the operator may manipulate an auto-hold command input device to selectively enable and disable the tool auto-hold function.

BRIEF DESCRIPTION OF THE DRAWINGS

FIG. 2 is a schematic diagram of a loader bucket orientation sensing and automatic control system.

FIG. 3 is a schematic diagram of a backhoe bucket orientation sensing and automatic control system.

FIG. 4 is a schematic diagram showing a frame tilt sensor in communication with a controller.

DESCRIPTION OF THE ILLUSTRATED EMBODIMENT

Figure 1:
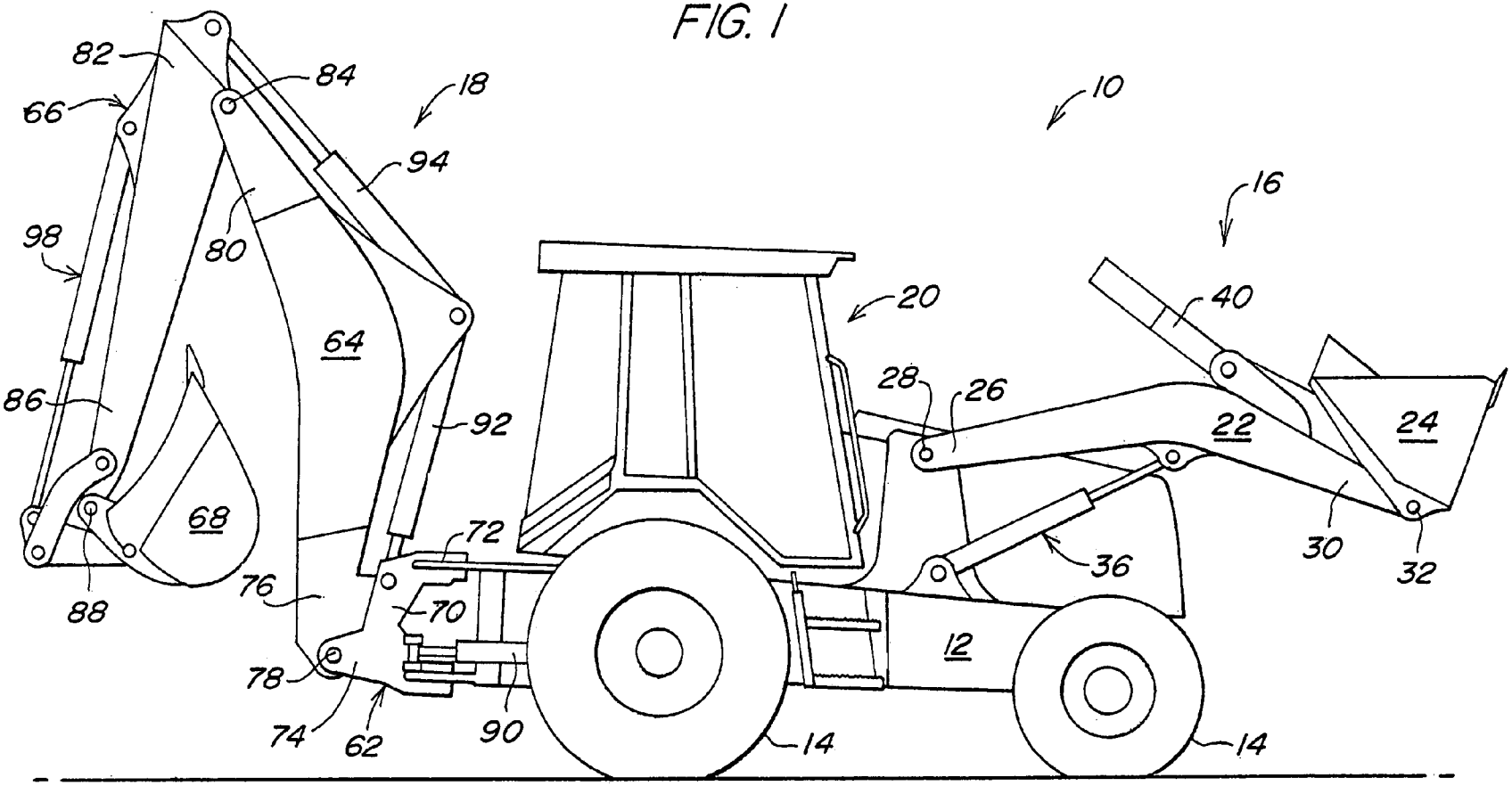
FIG. 1 is a side view of a backhoe loader.

FIG. 1 illustrates a self-propelled work vehicle, such as a backhoe loader 10. The backhoe loader 10 has a frame 12, to which are attached ground engaging wheels 14 and 15 for supporting and propelling the vehicle 10. Attached to the front of the vehicle is a loader assembly 16, and attached to the rear of the vehicle is a backhoe assembly 18. Both the loader assembly 16 and backhoe assembly 18 each perform a variety of excavating and material handling functions. An operator controls the functions of the vehicle 10 from an operator's station 20.

The loader assembly 16 comprises a loader boom 22 and a tool such as a loader bucket or other structure 24. The loader boom 22 has a first end 26 pivotally attached to the frame 12 about a horizontal loader boom pivot 28, and a second end 30 to which the loader bucket 24 pivotally attaches about a horizontal loader bucket pivot 32.

A loader boom actuator, having a loader boom hydraulic cylinder 36 extending between the vehicle frame 12 and the loader boom 22, controllably moves the loader boom 22 about the loader boom pivot 28. A loader bucket actuator 38, having a loader bucket hydraulic cylinder 40 extending between the loader boom 22 and the loader bucket 24, controllably moves the loader bucket 24 about the loader bucket pivot 32. In the illustrated embodiment, the loader bucket actuator 38 comprises a loader bucket electro-hydraulic circuit 42 hydraulically coupled to the loader bucket hydraulic cylinder 40. The loader bucket electro-hydraulic circuit 42 supplies and controls the flow of hydraulic fluid to the loader bucket hydraulic cylinder 40.

The operator commands movement of the loader assembly 16 by manipulating a loader bucket command input device 44 and a loader boom command input device 46. The loader bucket command input device 44 is adapted to generate a loader bucket command signal 48 in response to manipulation by the operator, proportional to a desired loader bucket movement. A controller 50, in communication with the loader bucket command input device 44 and loader bucket actuator 38, receives the loader bucket command signal 48 and responds by generating a loader bucket control signal 52, which is received by the loader bucket electro-hydraulic circuit 42. The loader bucket electro-hydraulic circuit 42 responds to the loader bucket control signal 52 by directing hydraulic fluid to the loader bucket hydraulic cylinder 40, causing the hydraulic cylinder 40 to move the loader bucket 24 accordingly.

During a work operation with the loader bucket 24, such as lifting or transporting material, it is desirable to maintain an initial loader bucket orientation relative to gravity to prevent premature dumping of material. To maintain the initial loader bucket orientation as the loader boom 22 is moved relative to the frame 12 during a lifting operation, and as the vehicle frame 12 changes pitch when moving over uneven terrain during a transport operation, the operator is required to continually manipulate the loader bucket command input device 44 to adjust the loader bucket orientation. The continual adjustment of the loader bucket orientation requires a degree of operator attention and manual effort that diminishes overall work efficiency and increases operator fatigue.

FIG. 2 illustrates an improved actuator control system adapted to automatically maintain an initial or a set loader bucket orientation or tilt angle with respect to the earth. The present invention makes use of a loader bucket tilt angle sensor 54 attached to the loader bucket 24, in communication with the controller 50. The loader bucket tilt angle sensor 54 is adapted to sense an angle of the bucket relative to the earth and to generate a corresponding loader bucket angle signal 56. The controller 50 is adapted to receive the loader bucket angle signal 56 and to generate a loader bucket control signal 52 in response, causing the loader bucket actuator 38 to move the loader bucket 24 to achieve a desired loader bucket angle. Where the object of the invention is an auto-hold function to maintain the initial loader bucket angle set by the operator, relative to gravity, the desired loader bucket angle is maintained. Additionally, the controller 50 is adapted to suspend the auto-hold function when the operator commands movement of the loader bucket 24, i.e., upon receiving the loader bucket command signal 48, and reestablishing the initial loader bucket orientation as the orientation of the loader bucket 24 immediately after the loader bucket command signal 48 terminates.

In the illustrated embodiment, the present invention also utilizes a loader auto-hold command switch 58 in communication with the controller 50. The loader auto-hold command switch 58 is adapted to generate a loader auto-hold command signal 60 corresponding to a manipulation of the loader auto-hold command switch 58 by the operator to enable operation of the auto-hold function for the loader bucket 24. The controller 50 is adapted to ignore the loader bucket angle signal 56 until the controller 50 receives the loader auto-hold command signal 60 from the loader auto-hold command switch 58.

In the illustrated embodiment, a loader boom tilt angle sensor 57, for detecting the angle of the loader boom 22 relative to the earth and automatically generating loader boom angle signals, is attached to the loader boom 22. The controller 50 is also capable of receiving the loader boom angle signals generated by the boom tilt angle sensor 57 and automatically generating the loader bucket control signals based on the loader boom angle signals.

The backhoe assembly 18 comprises a swing frame 62, a backhoe boom 64, a dipperstick 66, and a backhoe tool such as a backhoe bucket or other structure 68. The swing frame 62 has a first swing frame end 70 pivotally attached to the frame 12 about a vertical pivot 72, and a second swing frame end 74. The backhoe boom 64 has a first backhoe boom end 76 pivotally attached to the second swing frame end 74 about a horizontal backhoe boom pivot 78, and a second backhoe boom end 80. The dipperstick 66 has a first dipperstick end 82 pivotally attached to the second backhoe boom end 80 about a horizontal dipperstick pivot 84, and a second end 86 to which the backhoe bucket 68 pivotally attaches via a backhoe bucket pivot 88.

A swing frame actuator, including a swing frame hydraulic cylinder 90 extending between the vehicle frame 12 and the swing frame 62, controllably moves the swing frame 62 about the vertical pivot 72. A backhoe boom actuator, including a backhoe boom hydraulic cylinder 92 extending between the swing frame 62 and the backhoe boom 64, controllably moves the backhoe boom 64 about the backhoe boom pivot 78. A dipperstick actuator, including a dipperstick hydraulic cylinder 94 extending between the backhoe boom 64 and the dipperstick 66, controllably moves the dipperstick 66 about the dipperstick pivot 84. A backhoe bucket actuator 96, including a backhoe bucket hydraulic cylinder 98 extending between the dipperstick 66 and the backhoe bucket 68, controllably moves the backhoe bucket 68 about the backhoe bucket pivot 88. In the illustrated embodiment, the backhoe bucket actuator 96 comprises a backhoe bucket electro-hydraulic circuit 100, in connection the backhoe bucket hydraulic cylinder 98, which supplies and controls the flow of hydraulic fluid to the backhoe bucket hydraulic cylinder 98.

The operator commands movement of the backhoe assembly 18 by manipulating a backhoe bucket command input device 102, a dipperstick command input device 104, a backhoe boom command input device 106, and a swing frame command input device. The backhoe bucket command input device 102 is adapted to generate a backhoe bucket command signal 108 in response to manipulation by the operator, proportional to a desired backhoe bucket movement. The controller 50, in communication with the backhoe bucket command input device 102, dipperstick command input device 104, backhoe boom command input device 106, and the backhoe bucket actuator 96, receives the backhoe bucket command signal 108 and responds by generating a backhoe bucket control signal 110, which is received by the backhoe bucket electro-hydraulic circuit 100. The backhoe bucket electro-hydraulic circuit 100 responds to the backhoe bucket control signal 110 by directing hydraulic fluid to the backhoe bucket hydraulic cylinder 98, causing the hydraulic cylinder 98 to move the backhoe bucket 68 accordingly.

During a work operation with the backhoe bucket 68, such as lifting or excavating material, it is, at times, desirable to maintain an initial backhoe bucket orientation relative to the earth to prevent premature dumping of material or to obtain a constant excavation shear angle. To maintain the initial backhoe bucket orientation relative to gravity, the operator is required to continually manipulate the backhoe bucket command input device 102 to adjust the backhoe bucket orientation as the backhoe boom 64 and dipperstick 66 are moved during the work operation. The continual adjustment of the backhoe bucket orientation, combined with the simultaneous manipulation of the backhoe boom command input device 106 and the dipperstick command input device 104 inherent in movement of the backhoe boom 64 and dipperstick 66, requires a degree of operator attention and manual effort that diminishes overall work efficiency and increases operator fatigue.

FIG. 3 illustrates an improved actuator control system adapted to automatically maintain an initial, or a set, backhoe bucket orientation, or angle. The invention makes use of a backhoe bucket tilt angle sensor 112 attached to the backhoe bucket 68, in communication with the controller 50. The backhoe bucket tilt angle sensor 112 is adapted to sense a backhoe bucket tilt angle relative to the earth and to generate a corresponding backhoe bucket angle signal 114. The controller 50 is adapted to receive the backhoe bucket signal 114 and to generate a backhoe bucket control signal 110 in response, causing the backhoe bucket actuator 96 to move the backhoe bucket 68 to achieve an angle with respect to the earth. Where the object of the invention is an auto-hold function to maintain the initial backhoe bucket orientation set by the operator, relative to the earth, the set backhoe bucket angle is maintained. Additionally, the controller 50 is adapted suspend the auto-hold function while the operator commands movement of the backhoe bucket 68 when receiving the backhoe bucket command signal 108, and reestablishing the initial backhoe bucket orientation as the set orientation of the backhoe bucket 68 immediately after the backhoe bucket command signal 108 terminates.

The invention also utilizes a backhoe auto-hold command switch 116 in communication with the controller 50. The backhoe auto-hold command switch 116 is adapted to generate a backhoe auto-hold command signal 118 corresponding to a manipulation of the backhoe auto-hold command switch 116 by the operator to enable operation of the auto-hold function for the backhoe bucket 68. The controller 50 is adapted to ignore the backhoe bucket angle signal 114 until the controller 50 receives the backhoe auto-hold command signal 118 from the backhoe auto-hold command switch 116.

In the alternate embodiment, where a backhoe work operation is typically performed only when the vehicle is stationary, adjustments to maintain the initial backhoe bucket orientation normally result only from a corresponding movement of the backhoe boom 64 or the dipperstick 66. To minimize the period of auto-hold function for the backhoe bucket 68, the controller 50 may be adapted to ignore the backhoe bucket angle signal 114 unless receiving a backhoe boom command signal 122 from the backhoe boom command input device 106, or a dipperstick command signal 120 from the dipperstick command input device 104.

In the illustrated embodiment, a backhoe boom tilt angle sensor 63 is attached to the backhoe boom 66 and a dipperstick tilt angle sensor 67 is attached to the dipperstick 64. The controller 50 is also capable of receiving backhoe boom angle signals and dipperstick angle signals relative to the earth generated by the boom tilt angle sensor and the dipperstick tilt angle sensor, respectively and automatically generating backhoe bucket control signals based on at least one of the backhoe boom angle signals an the diperstick angle signals.

FIG. 4 illustrates a frame tilt sensor 73 attached to the frame 12. The frame tilt sensor 73 detects an inclination of the frame 12 with respect to the earth and generates a corresponding frame inclination signal 75. The controller 50 is capable of automatically generating a tool control signal based on the frame inclination signal, the boom inclination signal, the dipperstick inclination signal and the tool inclination signal.

Having described the illustrated embodiment, it will become apparent that various modifications can be made without departing from the scope of the invention as defined in the accompanying claims.

The invention claimed is:

1. A work vehicle comprising:

a frame;

a boom having a first boom end and a second boom end, the first boom end pivotally attached to the frame;

a dipperstick having a first dipperstick end and a second dipperstick end, the first dipperstick end pivotally attached to the second boom end;

a tool pivotally attached to the second dipperstick end, the tool being adapted to perform a work function;

a tool actuator adapted to controllably pivot the tool about the second dipperstick end;

a boom actuator adapted to controllably pivot the boom about the frame;

a dipperstick actuator adapted to controllably pivot the dipperstick about the second boom end;

a controller in communication with the tool actuator and at least one of the boom actuator and the dipperstick actuator;

a tool command input device in communication with the controller, the tool command input device adapted to generate a first signal upon a manipulation of the tool command input device corresponding to a desired tool movement; and a tilt sensor attached to the tool, the tilt sensor detecting an inclination of the tool with respect to the earth and generating a corresponding second signal indicative of the inclination, the controller being capable of receiving the first signal and generating first tool control signals controlling at least one of the tool actuator, the boom actuator and the dipperstick actuator, the controller capable of receiving the second signal and generating second tool control signals controlling the at least one of the tool actuator, the boom actuator and the dipperstick actuator.

2. The work vehicle of claim 1 further comprising an auto-hold command switch, the auto-hold command switch being in communication with the controller and capable of generating a first auto-hold signal upon a first auto-hold manipulation and a second auto-hold signal upon a second auto-hold manipulation.

3. The work vehicle of claim 2, wherein the first auto-hold signal instructs the controller to ignore the second signal and to generate the first tool control signals based on the first signal.

4. The work vehicle of claim 3, wherein the second auto-hold signal instructs the controller to generate the second tool control signals based on the second signal.

5. The work vehicle of claim 3, wherein the second auto-hold signal instructs the controller to create a stored tool inclination by storing the inclination of the tool and to automatically generate the second tool control signals to continually adjust the tool actuator so that the actual inclination of the tool is about equal to the stored inclination.

6. A tool control system for a work vehicle, the work vehicle having a frame, the tool control system comprising:

a boom having a first boom end and a second boom end, the first boom end pivotally attached to the frame;

a dipperstick having a first dipperstick end and a second dipperstick end, the first dipperstick end pivotally attached to the second boom end;

a tool pivotally attached to the second dipperstick end, the tool being adapted to perform a work function;

a tool actuator adapted to controllably pivot the tool about the second dipperstick end;

a boom actuator adapted to controllably pivot the boom about the frame;

a dipperstick actuator adapted to controllably pivot the dipperstick about the second boom end;

a controller in communication with the tool actuator and at least one of the boom actuator and the dipperstick actuator;

a tool command input device in communication with the controller, the tool command input device adapted to generate a first signal upon a manipulation of the tool command input device corresponding to a desired tool movement; and a tilt sensor attached to the tool, the tilt sensor detecting an inclination of the tool with respect to the earth and generating corresponding a second signal indicative of the inclination, the controller being capable of receiving the first signal and generating first tool control signals controlling at least one of the tool actuator, the boom actuator and the dipperstick actuator, the controller capable of receiving the second signal and generating second tool control signals controlling the at least one of the tool actuator, the boom actuator and the dipperstick actuator.

7. The tool control system of claim 6 further comprising an auto-hold command switch, the auto-hold command switch being in communication with the controller and capable of generating a first auto-hold signal upon a first auto-hold manipulation and a second auto-hold signal upon a second auto-hold manipulation.

8. The tool control system of claim 7, wherein the first auto-hold signal instructs the controller to ignore the second signal and to generate the first tool control signals based on the first signal.

9. The tool control system of claim 8, wherein the second auto-hold signal instructs the controller to generate the second tool control signals based only on the second signal.

10. The tool control system of claim 8, wherein the second auto-hold signal instructs the controller to create a stored tool inclination by storing the inclination of the tool and to automatically generate the second tool control signals to continually adjust the tool actuator so that the actual inclination of the tool is about equal to the stored inclination.

11. A tool control system for a vehicle having a frame, the tool control system comprising:

a linkage having a first end and a second end, the first end being pivotally attached to the frame at a first pivot;

a tool operatively attached to the second end;

a linkage actuator adapted to controllably impart motion to the linkage;

a tool actuator adapted to controllably pivot the tool about the second end;

a controller in communication with the linkage actuator and the tool actuator; and a tilt sensor attached to the tool, the tilt sensor detecting an inclination of the tool with respect to the earth and generating a corresponding tool inclination signal, the controller being capable of automatically generating a tool control signal controlling at least one of the linkage actuator and the tool actuator based on the tool inclination signal.

12. The tool control system of claim 11, further comprising a storage device, the storage device being capable of receiving and storing a set tool inclination value.

13. The tool control system of claim 12, wherein the set tool inclination value corresponds to the tool inclination signal.

14. The tool control system of claim 12, wherein the controller generates the tool control signal to keep the tool at an inclination that is about equal to the set tool inclination value.

15. The tool control system of claim 11, wherein the linkage comprises a boom having a first boom end and a second boom end, the first boom end corresponding to the first end of the linkage, the second boom end corresponding to the second end of the linkage.

16. The tool control system of claim 12, wherein the linkage comprises a boom having a first boom end and a second boom end, a dipperstick having a first dipperstick end and a second dipperstick end, the first boom end corresponding to the first linkage end, the second dipperstick end corresponding to the second linkage end, the second boom end and the first dipperstick end being pivotally connected at a second pivot.

17. The tool control system of claim 16, wherein the linkage actuator comprises a boom actuator and a dipperstick actuator, the boom actuator capable of controllably pivoting the boom about the first pivot, the dipperstick actuator capable of pivoting the dipperstick about the second pivot.

18. The tool control system of claim 17, further comprising:

a boom tilt sensor attached to the boom; and a dipperstick tilt sensor attached to the dipperstick, the boom tilt sensor detecting an inclination of the boom with respect to the earth and generating a corresponding boom inclination signal, the dipperstick tilt sensor detecting an inclination of the dipperstick with respect to the earth and generating a corresponding dipperstick inclination signal, the controller being capable of automatically generating the second tool control signal based on the boom inclination signal, the dipperstick inclination signal and the tool inclination.

19. The tool control system of claim 17, further comprising:

a boom tilt sensor attached to the boom; and a dipperstick tilt sensor attached to the dipperstick, the boom tilt sensor detecting an inclination of the boom with respect to the earth and generating a corresponding boom inclination signal, the dipperstick tilt sensor detecting an inclination of the dipperstick with respect to the earth and generating a corresponding dipperstick inclination signal, the controller being capable of using the boom inclination signal, the dipperstick inclination signal and the tool inclination signal to calculate the absolute position of the tool with respect to the frame.

20. The tool control system of claim 18, further comprising a frame tilt sensor attached to the frame, the frame tilt sensor detecting an inclination of the frame with respect to the earth and generating a corresponding frame inclination signal, the controller being capable of automatically generating the second tool control signal based on the frame inclination signal, the boom inclination signal, the dipperstick inclination signal and the tool inclination signal.

21. A method of linkage coordination for a work vehicle having a frame, a linkage and a tool, the tool being connected to the linkage at a position different from that of the body, the method comprising:

detecting an angle of a tool with respect to the earth with a tool tilt sensor;

generating a tool angle signal with the tool tilt sensor, the tool angle signal corresponding to the angle of the tool with respect to the earth;

automatically generating a tool control signal with a controller, the tool control signal being based on the tool angle signal.

22. A method of linkage coordination for a work vehicle, the work vehicle including a tool, an auto-hold command switch, a tool tilt sensor, and a controller, the method comprising:

recording a set angle of a tool with respect to the earth with the auto-hold command switch;

detecting an angle of the tool with respect to the earth with the tool tilt sensor;

generating a tool angle signal with the tool tilt sensor, the tool angle signal corresponding to the angle of the tool;

automatically generating a tool control signal with the controller, the tool control signal being based on the tool angle signal, the tool control signal causing the tool actuator to keep the tool angle at approximately the set angle of the tool.

* * * * *